US009685705B2

(12) United States Patent
Azad

(10) Patent No.: US 9,685,705 B2
(45) Date of Patent: Jun. 20, 2017

(54) WIDE BAND ANTENNA

(71) Applicant: Wistron Corporation, New Taipei (TW)

(72) Inventor: Mohammed Ziaul Azad, Rolling Meadows, IL (US)

(73) Assignee: Wistron Corporation, New Taipei (TW)

( * ) Notice: Subject to any disclaimer, the term of this patent is extended or adjusted under 35 U.S.C. 154(b) by 179 days.

(21) Appl. No.: 14/560,677

(22) Filed: Dec. 4, 2014

(65) Prior Publication Data

US 2016/0164183 A1 Jun. 9, 2016

(51) Int. Cl.

| | |
|---|---|
| ***H01Q 9/30*** | (2006.01) |
| ***H01Q 9/42*** | (2006.01) |
| ***H01Q 1/24*** | (2006.01) |
| *H01Q 5/371* | (2015.01) |

(52) U.S. Cl.
CPC ..... *H01Q 9/42* (2013.01); *H01Q 1/243* (2013.01); *H01Q 5/371* (2015.01)

(58) Field of Classification Search
CPC ..... H01Q 9/42; H01Q 1/243; H01Q 5/371
USPC ..... 343/700 MS, 702
See application file for complete search history.

(56) References Cited

U.S. PATENT DOCUMENTS

| | | | | |
|---|---|---|---|---|
| 7,911,390 | B2 | 3/2011 | Chiu | |
| 2007/0115183 | A1* | 5/2007 | Kim | H01Q 1/243 343/700 MS |
| 2010/0117909 | A1* | 5/2010 | DeJean | H01Q 9/40 343/702 |

OTHER PUBLICATIONS

Wong et al., "A Low-Profile Planar Monopole Antenna for Multiband Operation of Mobile Handsets," *IEEE Transactions on Antennas and Propagation*, 51(1): 121-125 (2003).

* cited by examiner

*Primary Examiner* — Dameon E Levi
*Assistant Examiner* — David Lotter
(74) *Attorney, Agent, or Firm* — Leydig, Voit & Mayer, Ltd.

(57) ABSTRACT

A wide band antenna for interfacing an electronic device with a plurality of radio access technologies is provided. The antenna includes a first resonator and a second resonator. Both the first resonator and the second resonator are attached to an antenna feed structure. The length of the first resonator provides one mode of operation of the antenna, and the length of the second resonator provides a second mode of operation of the antenna. And a third mode of operation of the antenna is provided by mutual coupling and current flow between both the first resonator and the second resonator.

18 Claims, 6 Drawing Sheets

WIDE BAND ANTENNA

FIELD OF THE INVENTION

This invention generally relates to an antenna for an electronic device, and more particularly to a wide band antenna capable of operating over relevant frequency bandwidths for a plurality of radio access technologies.

BACKGROUND OF THE INVENTION

As mobile voice and data demands increase, demand for wireless electronic devices that can operate over a plurality of radio access technology increases. The various radio access technologies operate over a range of frequencies in the electro-magnetic spectrum. As an example, most mobile voice and data network carriers utilize LTE, GSM and UMTS bands covering frequency ranges from 791 to 960 MHz for the low band, 1710-2170 MHz for the mid band and 2500-2700 MHz for the high band. In order for an electronic device such as a mobile device to interface with voice and data networks over these various radio access technologies, the mobile device will need to be equipped with an antenna configured to operate over the relevant bandwidth for that radio access technology. Typically, this requires having multiple antenna Stock Keeping Units (SKUs) with each SKU directed to providing access to a subset of the total bandwidth required to communicate effectively over the plurality of radio access technologies.

Additionally, as demand for voice and data services increases, so does the demand for mobile devices to have greater processing power and support a greater number of user features. This demand persists even in contrast with a drive for thinner mobile devices that contain less internal physical space in which to house the processors, memory and various other electrical and mechanical structures required to meet the demand for greater processing power and greater number of user features.

In this regard, less physical space within the mobile devices can be utilized for an antenna(s) to allow the mobile device to operate over various radio access technologies. Accordingly, a need exists for a single wide band antenna design capable of operating over frequencies relevant to a plurality of radio access technologies.

BRIEF SUMMARY OF THE INVENTION

One embodiment provides a wide band monopole-type antenna. The antenna includes an antenna feed structure configured to sense a signal and provide the signal to a receiver. The antenna further includes a first resonator including a first arm and a second arm arranged perpendicular to the first arm, and a second resonator including a first portion and a second portion. The first portion is configured to extend parallel to the first arm and the second portion is configured to wrap around the second arm. Wherein a first separation distance is formed between the first arm of the first resonator and the first portion of the second resonator.

Another embodiment provides an electronic device having a wide band monopole-type antenna and capable of wireless reception of electro-magnetic signals. The electronic device includes a wireless signal module. The electronic device also includes an antenna feed structure of the wide band monopole-type antenna, where the antenna feed structure is configured to provide the electro-magnetic signals to the wireless signal module. The electronic device also includes a first resonator of the wide band monopole-type antenna, where the first resonator includes a first arm and a second arm arranged perpendicular to the first arm. The electronic device also includes a second resonator of the wide band monopole-type antenna, where the second resonator includes a first portion and a second portion. The first portion is configured to extend parallel to the first arm and the second portion is configured to wrap around the second arm. Wherein a first separation distance is formed between the first arm of the first resonator and the first portion of the second resonator.

Yet another embodiment provides an antenna module for integration into an electronic device. The antenna module includes an antenna carrier configured to support at least one antenna structure. Wherein the at least one antenna structure includes a wide band monopole-type antenna disposed on the antenna carrier. And the wide band monopole-type antenna includes an antenna feed structure configured to sense a signal and provide the signal to a receiver. The wide band monopole-type antenna also includes a first resonator including a first arm and a second arm arranged perpendicular to the first arm. The wide band monopole-type antenna also includes a second resonator including a first portion and a second portion. The first portion is configured to extend parallel to the first arm and the second portion is configured to wrap around the second arm. Wherein a first separation distance is formed between the first arm of the first resonator and the first portion of the second resonator.

BRIEF DESCRIPTION OF THE SEVERAL VIEWS OF THE DRAWING(S)

The accompanying drawings incorporated in and forming a part of the specification illustrate several aspects of the present invention and, together with the description, serve to explain the principles of the invention. In the drawings.

DETAILED DESCRIPTION OF THE INVENTION

Figure 1:
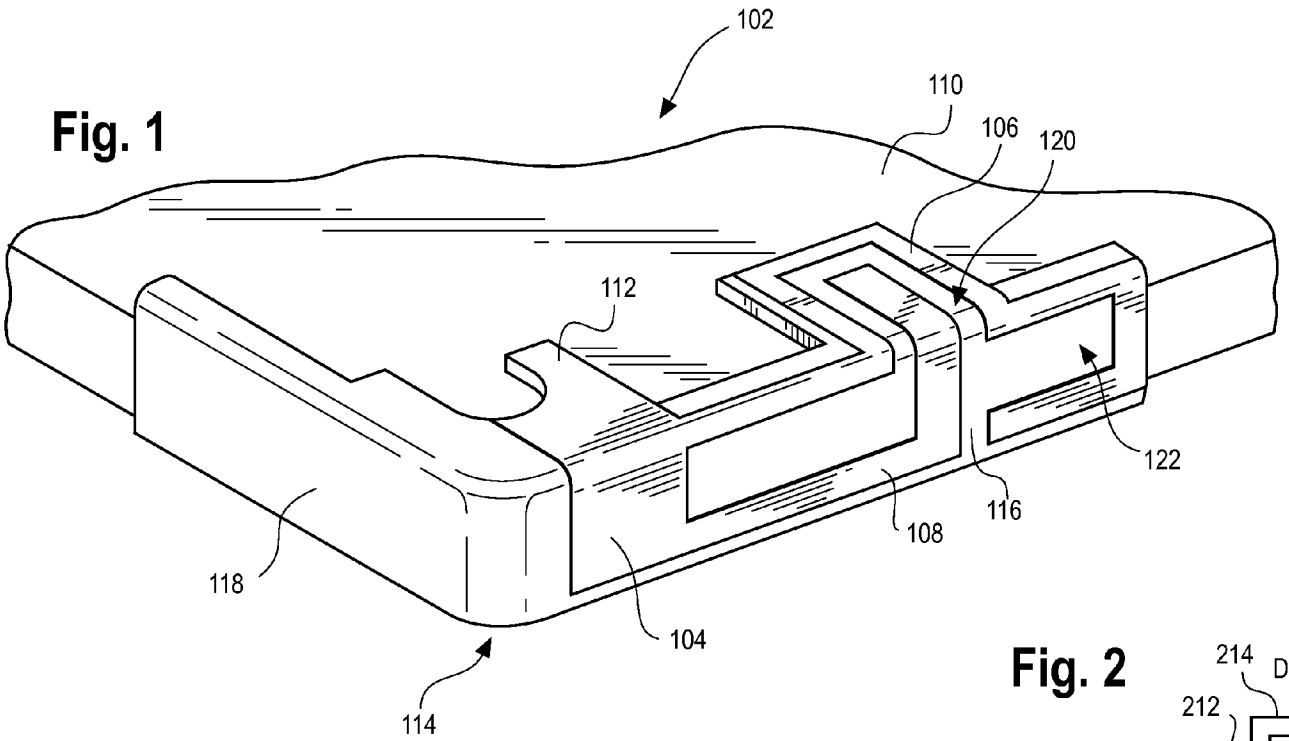
FIG. 1 is a perspective view of an antenna module including at least one antenna structure, such as a wide band monopole-type antenna, relative to a printed circuit board of an electronic device, according to an exemplary embodiment.

FIG. 1 illustrates an exemplary embodiment of a substrate 102 supporting a wide band monopole-type antenna 104 residing on an antenna carrier 114. The antenna 104 may be defined as a combination of a first resonator 108, a second resonator 106 and a ground structure 110. The substrate 102 can be represented by a rigid printed circuit board (PCB) constructed with a common compound such as FR-4, or a flexible PCB made of a compound such as Kapton™ (trademark of DuPont). The substrate 102 can comprise a multi-layer PCB having one layer as the ground structure 110 (or portions of the ground structure 110 dispersed in multiple layers of the PCB). The ground structure 110 can be planar, or a curved surface in the case of a flexible PCB. For convenience, the ground structure 110 will be referred to herein as a ground plane without limiting the possibility that the ground structure 110 can be curved or formed by several inter-coupled conducting sections that do not necessarily belong to the same or any substrate. The PCB can support components making up portions of a transceiver (the transceiver includes a signal transmitter and a signal receiver) and a controller (see wireless signal module 1002 of FIG. 10). Suitable ground structures may be constructed from multiple inter-coupled layers or inter-coupled sections as well (for instance, clam shell or slider phones have ground structures that are realized by suitable interconnection of various sub-structures). In certain embodiments, the extremities of the ground structure 110 form an approximately rectangular shape having a length dimension and a width dimension, which may be average dimensions. In some phone designs, such as a clam shell or slider phone, the length of the ground plane may change as the orientation of phone parts is changed. The shape may be approximately rectangular in that it may be, for example tapered or trapezoidal to fit a housing, and as mentioned above, may be curved to conform to a housing, and the edges may not be straight or smooth—for example when an edge of the ground plane has to bypass a feature of a housing such as a plastic mating pin or post.

In the illustrated embodiment, the antenna 104 includes an antenna feed structure 112, the second resonator 106 and the first resonator 108. The antenna feed structure 112 is connected to a wireless signal module 1002 (see FIG. 10). The wireless signal module 1002 (see FIG. 10) is configured to function as a signal source that provides an excitation signal to the second resonator 106 and the first resonator 108 or as a signal destination that receives signals such as electro-magnetic signals detected by the second resonator 106 and the first resonator 108. The second resonator 106 is generally configured to resonate at a lower frequency than the first resonator 108, and both the second resonator 106 and the first resonator 108 are arranged such that mutual coupling and current flow in opposite directions increases a useable bandwidth of the antenna 104.

In the illustrated embodiment, the antenna 104 is supported by an antenna carrier 114. The antenna carrier 114 is configured to support at least one antenna, such as the antenna 104. In other embodiments, secondary antenna(s), such as a WiFi/Bluetooth antenna, may be supported on the antenna carrier 114 as well. The antenna carrier 114 is configured to be contained within a housing of the electronic device 1000 (see FIG. 10) in which the antenna 104 is utilized. In the illustrated embodiment, the antenna carrier 114 is configured to rest on the PCB 102 along the bottom and left side of the PCB 102. However, other suitable configurations exist, such as an antenna carrier configured to rest on the PCB 102 along the bottom and right side of the PCB 102.

The antenna carrier 114 includes a main support structure 116 and a secondary support structure 118. The main support structure 116 is configured to rest along the bottom of the PCB 102 and supports the antenna 104. In certain embodiments, the main support structure 116 supports the antenna 104 in two planes. Specifically, the first plane 120 and a second plane 122 such that portions of the antenna 104 lie in one of the first plane 120 or second plane 122. The second plane 122 is comprised of a flat surface approximately between 30 and 45 mm long and between 2 and 7 mm wide. The first plane 120 is shaped such that it can support the antenna 104 and not interfere with other devices residing within the electronic device 1000 (see FIG. 10). For instance, the main support structure 116 is shaped such that the antenna 104 supported thereon does not interfere with devices such as a camera (either front or rear facing), a flash, a high speed interface, a speaker and various flex circuits. In this manner, the antenna carrier 114 is configured to support at least one antenna structure and not interfere with or be interfered with by various components in close proximity of the antenna 104.

In the illustrated embodiment, the secondary support structure 118 is a flat surface that rests along a left side of the PCB 102. The secondary support structure 118 is approximately between 20 and 35 mm in length and between 2 and 7 mm wide. Further, in some embodiments, the secondary support structure 118 may be configured to support a secondary antenna such as a WiFi/Bluetooth antenna with little to no interference with the performance of the antenna 104.

Figure 2:
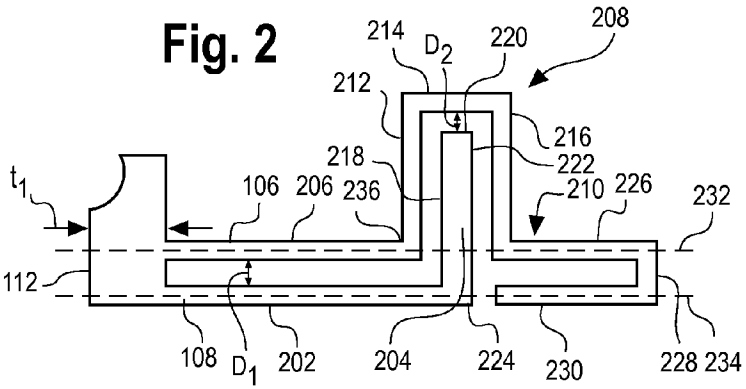
FIG. 2 is a view of the wide band monopole-type antenna of FIG. 1, according to an exemplary embodiment.

FIG. 2 illustrates an up-close view of the antenna 104, according to an example embodiment. As discussed above, the antenna 104 includes the second resonator 106 and the first resonator 108. The second resonator 106 and the first resonator 108 are both connected to the antenna feed structure 112. The first resonator 108 further includes a first arm 202 and a second arm 204. The first arm 202 includes a first end attached to the antenna feed structure 112 and a second end attached to the second arm 204 with a first arm length spanning the distance between the first and second ends of the first arm 202. The first arm 202 is a substantially straight linear extension from the antenna feed structure 112.

The second arm 204 is attached to the second end of the first arm 202. The second arm 204 has a substantially rectangular shape that includes a first side 218, a second side 220, a third side 222 and a fourth side 224. In the illustrated embodiment, the second arm 204 includes a substantially straight linear length that is arranged perpendicular to the first arm 202. As illustrated in FIG. 2, the first arm 202 and the second arm 204 of the first resonator 108 are arranged to form an "L" shape.

The antenna 104 also includes the second resonator 106, which includes a first portion 206, a second portion 208 and a third portion 210. The first portion 206 is connected to the antenna feed structure 112 at an attachment end and connected to the second portion 208 at a distal end 236 of the first portion 206. In the illustrated embodiment, the first portion is substantially straight linear length structure that is arranged substantially parallel to the first arm 202 of the first resonator 108.

The second portion 208 of the second resonator 106 wraps around the second arm 204 of the first resonator 108. The second portion 208 includes a first section 212, a second section 214 and a third section 216. The first section 212, the second section 214 and the third section 216 are substantially linear straight structures. The first section 212 is arranged substantially perpendicular to the first portion 206, and is attached to the distal end 236 of the first portion. The second section 214 is attached to the first section 212 at one end and the third section 216 at the other end, and is arranged such that it is substantially parallel to the second side 220 of the second arm 204 and substantially perpendicular to the first section 212. The third section 216 is attached to the second section 214 at one end and the third portion 210 at the other end, and is arranged such that it is substantially parallel to the third side 222 of the second arm 204 and substantially perpendicular to the second section 214.

In the illustrated embodiment, the third portion 210 is attached to an end of the third section 216 of the second portion 208 that is opposite from the end contacting the second section 214. Additionally, the third portion 210 extends in a generally perpendicular direction from the third section 216. In certain embodiments, the third portion 210 includes multiple segments, such as first segment 226, second segment 228 and third segment 230. In the illustrated embodiment, each of the first segment 226, second segment 228 and third segment 230 are substantially straight linear structures. The first segment 226 is attached to the third section 216 and extends perpendicularly therefrom. The second segment 228 is attached to an end of the first segment 226 opposite from the end of the first segment 226 attached to the third section 216. The second segment 228 extends substantially perpendicular to the first segment 226. The third segment 230 extends perpendicularly from an end of the second segment 228 that is opposite from the end of the second segment 228 attached to the first segment 226. In this configuration, the first segment 226 is joined with the third segment 230 by the second segment 228, which is arranged to be substantially perpendicular to both the first and third segments 226 and 230.

In the embodiment illustrated in FIG. 2, the third portion 210 forms a structure that extends outward from the first and second portions 206 and 208 and then wraps back in toward the first and second portions 206 and 208. In this configuration, the first segment 226 and the first portion 206 of the second resonator 106 both lie along an axis 232, and the third segment 230 and the first arm 202 of the first resonator 108 both lie along a second axis 234.

Figure 6:
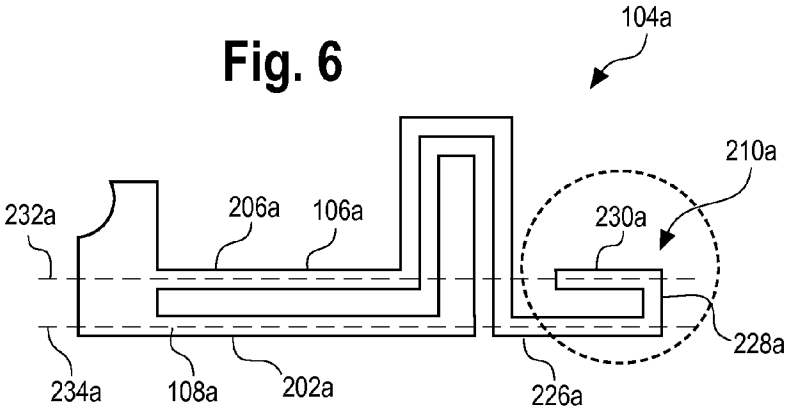
FIG. 6 is a view of a wide band monopole-type antenna according to a particular embodiment.

However, in other embodiments, the third portion 210 may be arranged in different configurations. For instance, as illustrated by antenna 104*a* in FIG. 6, the third portion 210*a* may comprise a first segment 226*a*, second segment 228*a* and third segment 230*a*. In the embodiment illustrated in FIG. 6, the first segment 226*a* and the first arm 202*a* of the first resonator 108*a* both lie along a second axis 234*a*, and the third segment 230*a* and the first portion 206*a* of the second resonator 106*a* both lie along an axis 232*a*. In the illustrated embodiment, the first segment 226*a* is joined with the third segment 230*a* by the second segment 228*a*, which is arranged to be substantially perpendicular to both the first and third segments 226*a* and 230*a*.

Figure 8:
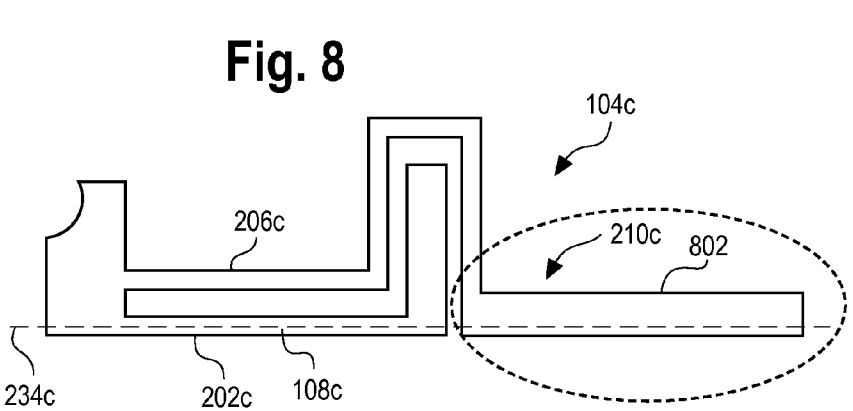
FIG. 8 is a view of a wide band monopole-type antenna according to a particular embodiment
Figure 7:
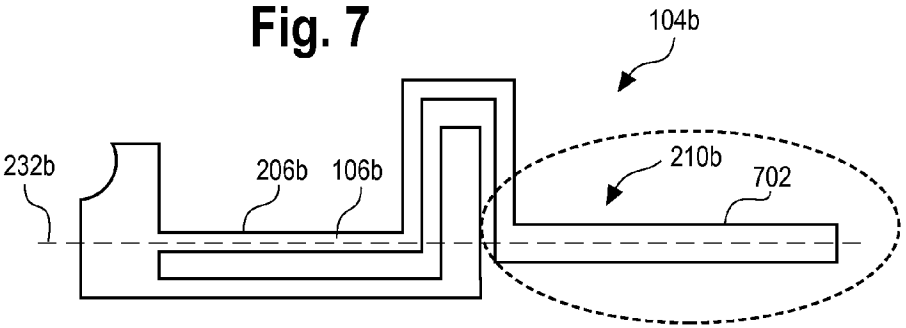
FIG. 7 is a view of a wide band monopole-type antenna according to a particular embodiment.

In another embodiment, the third portion 210 includes only a single straight linear segment, as illustrated in FIGS. 7 and 8. In FIG. 7, segment 702 and the first portion 206*b* of the second resonator 106*b* both lie along an axis 232*b*. While in FIG. 8, segment 802 and the first arm 202*c* of the first resonator 108*c* both lie along a second axis 234*c*.

In general, the third portion 210, 210*a*, 210*b* and 210*c* (see FIGS. 2 and 6-8) function similarly in that they are utilized to tune a resonant frequency of the second resonator 206, 206*a*, 206*b* and 206*c*. The various layouts of the third portion 210, 210*a*, 210*b* and 210*c* may serve to meet space or mechanical requirements for integration of antenna 104, 104*a*, 104*b* and 104*c* into an electronic device 1000 (see FIG. 10).

Returning now to FIG. 2, the antenna 104 is generally configured to resonate in multiple bandwidths relevant to a plurality of radio access technologies. More specifically, in the illustrated embodiment, the antenna 104 is configured to have resonance at the low bands covering the frequency range of 704-960 MHz, which are relevant to the Global System for Mobile Communications (GSM), the Universal Mobile Telecommunications System (UMTS) and Long Term Evolution (LTE) radio access technologies. The antenna 104 is further configured to have resonance at the mid bands covering the frequency range of 1710-2170 MHz, which are relevant to GSM, UMTS and LTE radio access technologies. The antenna 104 is further configured to have resonance at WiFi and Bluetooth frequencies covering a bandwidth between 2400-2485 MHz. And the antenna 104 is further configured to have resonance at the high bands covering the frequency range of 2500-2700 MHz, which is relevant to the LTE radio access technology. In this regard, in certain embodiments, the antenna 104 may function as a diversity antenna that is further able to provide coverage for WiFi and Bluetooth frequencies. In further embodiments, the antenna 104 may function as a main antenna for the electronic device when it can be placed at the bottom of the device structure with adequate flexibility in design and spacing away from all lossy components such as, but not limited to, a front facing or rear facing camera, a flash, a speaker, flex components and circuits.

The resonance of the low bands is created by the total length of the second resonator 106 including the total combined lengths of the first, second and third portions 206, 208 and 210. Accordingly, the total length of the second resonator 106 is generally a quarter wavelength of the relevant frequencies and is typically between 78-106 mm. And the resonance at the mid bands is created by a total length of the first resonator 108, including the total combined lengths of the first and second arms 202 and 204. Accordingly, the total length of the first resonator 108 is generally a quarter wavelength of the relevant frequencies and is typically between 34-44 mm.

In order to achieve wide band resonance at the mid band with the coverage for WiFi and Bluetooth frequencies, an interaction between the first and second resonators 108 and 106 must be tuned. This is achieved by varying various separation distances between both the first and second resonators 108 and 106. In particular, a separation between the first portion 206 of the second resonator 106 and the first arm 202 of the first resonator 108 creates a first separation gap distance $D_1$. And a separation between the second portion 208 of the second resonator 106 and the second arm 204 of the first resonator 108 creates a second separation gap distance $D_2$. By varying $D_1$ and $D_2$ a mutual coupling between the first and second resonators 108 and 106 can be tuned such that, in certain portions, current flows in opposite directions between the first and second resonators 108 and 106. Each gap separation distance $D_1$ and $D_2$ may range from approximately 0.5-2.5 mm.

Figure 3:
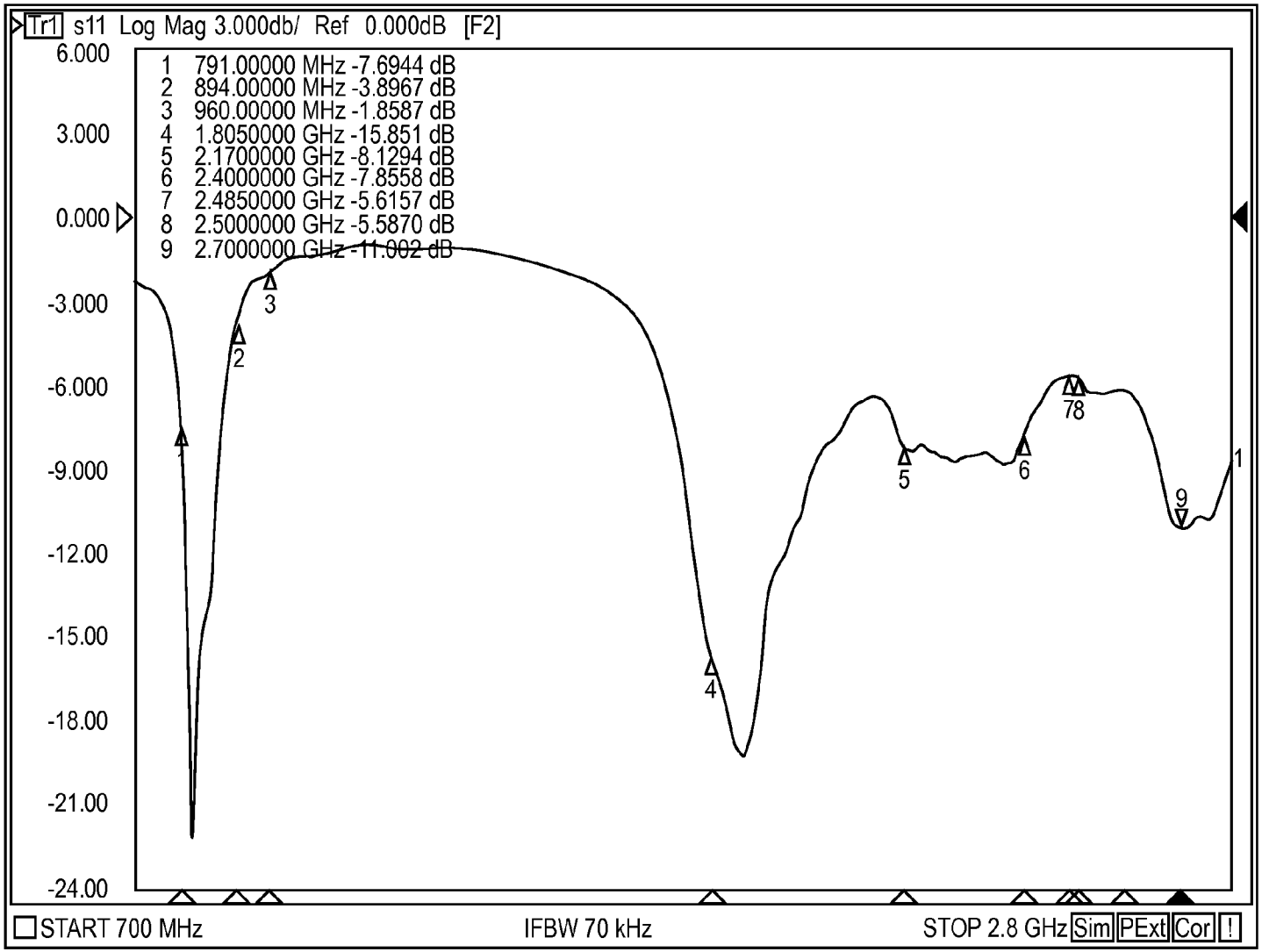
FIG. 3 is a plot of return loss for the wide band monopole-type antenna of FIG. 1, according to an exemplary embodiment.

FIG. 3 illustrates a plot of return loss of the antenna 104 over the relevant bandwidths for the low, mid, high, and WiFi/Bluetooth frequencies. In the upper left corner of the plot of return loss, a legend is provided which illustrates markers 1 and 3, which are relevant for the low bands; 4, and 5, which cover the mid bands; and 6, 7, 8 and 9, which cover the WiFi/Bluetooth and high bands. In general, an antenna with a return loss of less than −3 dB at a certain frequency would be considered to have bandwidth at that frequency. As can be seen in the legend, the highest value return loss for each of the above mentioned markers is generally less than −3.0 dB. However, the higher frequencies of the low band show slightly poor resonance, which can be corrected using tuning components, which will be discussed in relation to FIG. 5. Accordingly, with the addition of some tuning, the antenna 104 is capable of supporting each of the previously mentioned radio access technologies within the relevant bandwidths for low, mid, high, and WiFi/Bluetooth frequencies.

Figure 4:
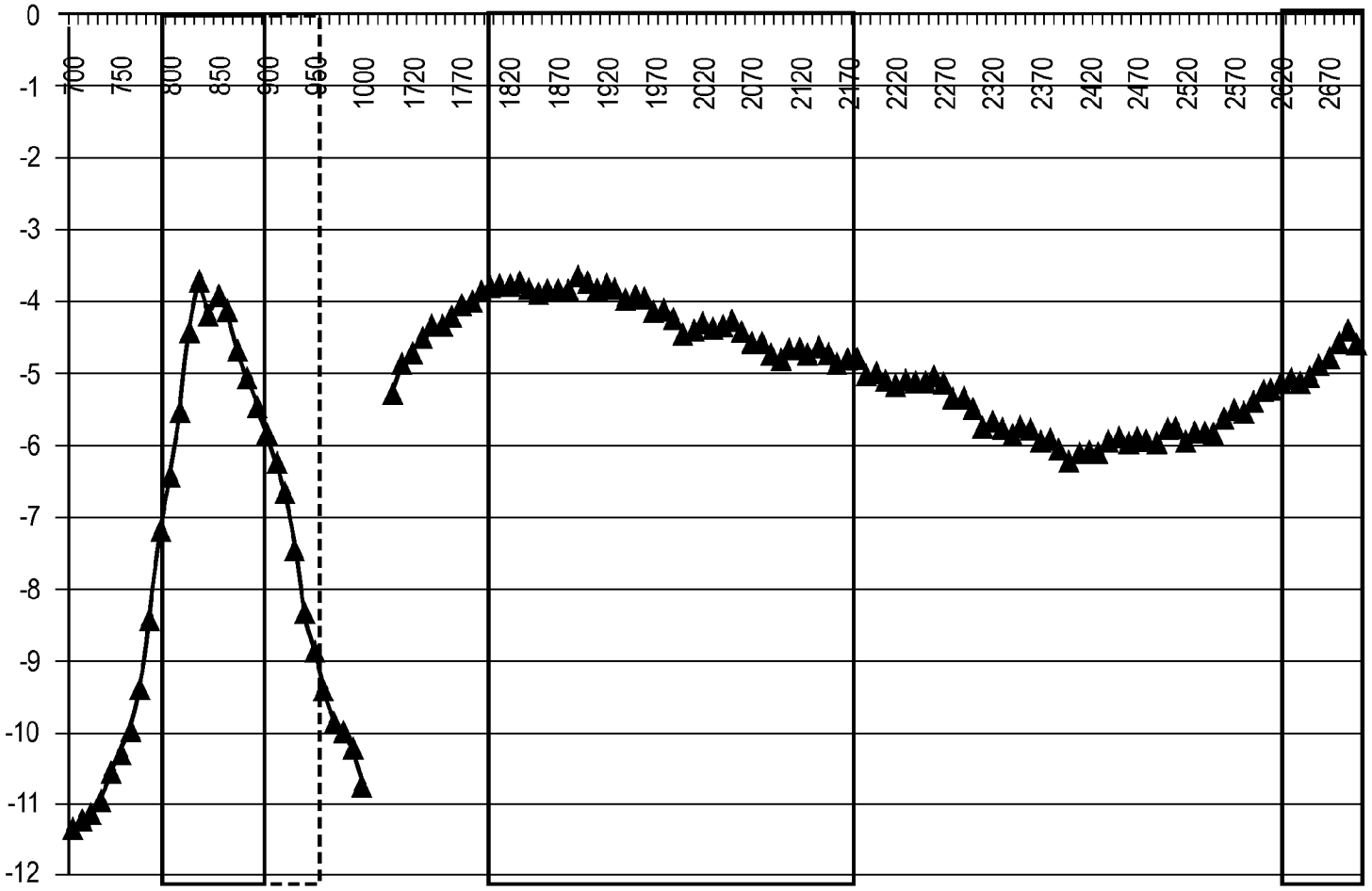
FIG. 4 is an efficiency plot for the wide band monopole-type antenna of FIG. 1, according to an exemplary embodiment.

FIG. 4 illustrates the efficiency of the antenna 104. The antenna 104 has good efficiency over the desired frequency bandwidths for the low, mid, high, and WiFi/Bluetooth bandwidths. As illustrated, the antenna 104 has a worst case efficiency of −7 dB and a best case of −3.8 dB in the low band and a worst case efficiency of −6.1 dB and a best case of −3.8 dB in the mid band, high band, and the WiFi/Bluetooth bandwidth.

Figure 5:
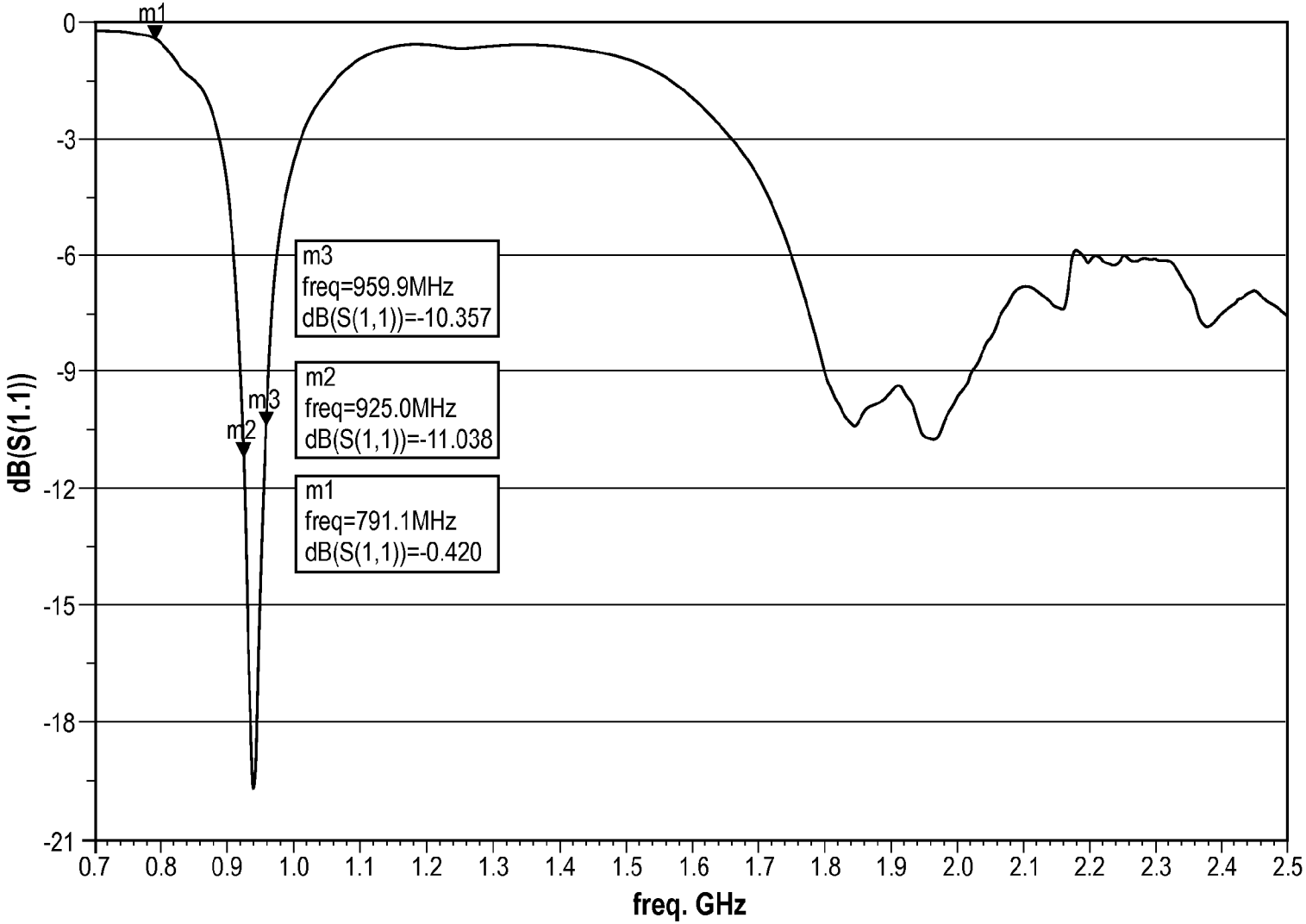
FIG. 5 is a plot of return loss for the wide band monopole-type antenna of FIG. 1 including a tuning element, according to an exemplary embodiment.

As mentioned in regards to FIG. 3, impedance matching using a tuner may be required to tune the specific resonance and bandwidths illustrated in FIG. 3 and efficiency illustrated in FIG. 4. For instance, impedance matching between the wireless signal module 1002 (see FIG. 10) and the antenna feed structure 112 for the antenna 104 may be utilized to achieve the desired bandwidth for the low band frequencies from 704-960 MHz, or any other bandwidth for diversity applications. FIG. 5 illustrates a plot of return loss of the antenna 104 focusing on the low band. As can be seen by markers 2 and 3, resonance at the higher frequencies of the low band can be improved over what is illustrated in FIG. 3 by adding a series tuning capacitor. By varying a value of the tuning capacitor, the frequency can be varied to provide better resonance throughout the low band without affecting the resonance at the mid, high, and WiFi/Bluetooth frequencies. Typically, the tuning capacitor ranges from 4.5 pF to 6.5 pF.

Figure 9:
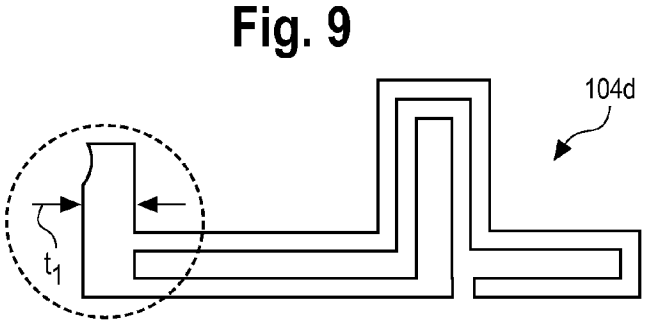
FIG. 9 is a view of a wide band monopole-type antenna according to a particular embodiment.

Returning briefly to FIG. 2, the antenna feed structure 112 includes a thickness $t_1$. However, this thickness can be narrowed in order to accommodate various mechanical restrictions related to integrating the antenna 104 into the electronic device 1000 (see FIG. 10). For instance, FIG. 9 illustrates antenna **104*d* with a narrower thickness $t_1$ than what is illustrated in FIG. 2**. The thicknesses $t_1$ can be between 3-7 mm.

Figure 10:
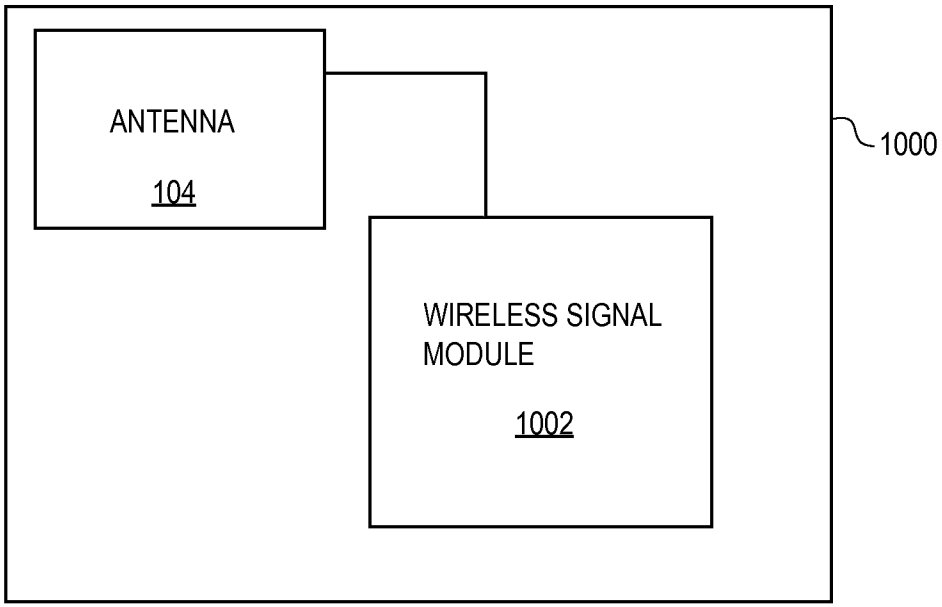
FIG. 10 is a block diagram of an electronic device including the wide band monopole-type antenna of FIG. 1, according to an exemplary embodiment.

FIG. 10 illustrates a block diagram of an electronic device 1000. The electronic device 1000 may be a cellular phone, a smart phone, a tablet computer, a laptop computer, a watch with a computer operating system, a personal digital assistant (PDA), a video game console, a wearable or embedded digital device(s), or any one of a number of additional devices capable of communicating over various radio access technologies. As illustrated, the electronic device 1000 includes a wireless signal module 1002 coupled to the antenna 104. The wireless signal module 1002 includes transceiver circuitry and a controller configured to process signals to transmit over the antenna 104 and process signals received from the antenna 104. The transceiver circuitry includes a transmitter and a receiver configured to operate over at least one radio access technology. In an embodiment where the antenna 104 is configured as a diversity antenna, the transceiver circuitry may be configured to only process signals received from the antenna 104 and not transmit signals over the antenna 104. The wireless signal module 1002 may be configured to communicate over any radio access technology. In certain embodiments, the wireless signal module 1002 may be configured to communicate over any one of or all of GSM, LTE, UMTS, GPS/GLONASS and/or WiFi/Bluetooth radio access technologies.

As used herein, the descriptions "substantially aligned," "substantially coextensive" or "substantially parallel," mean that, in some embodiments, the ratio of the closest separation (gap) and largest separation (gap) between the centerlines of the elongated conductors or arms or portions or antenna elements may be up to or greater than 1.5:1. In some embodiments this gap variation ratio may be substantially less, such as 1.2:1, or less than 1.05:1.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A wide band antenna, the antenna comprising:

an antenna feed structure configured to sense a signal and provide the signal to a receiver;

a first resonator including a first rectangular length and a second rectangular length arranged perpendicular to the first rectangular length; and a second resonator including a first portion and a second portion, the first portion is a substantially straight linear length structure that is configured to extend parallel to the first rectangular length and the second portion includes a plurality of rectangular lengths arranged rectilinear to each other, and the plurality of rectangular lengths are configured to wrap around the second rectangular length of the first resonator, wherein a first separation distance is formed between the first rectangular length of the first resonator and the first portion of the second resonator, wherein the first rectangular length of the first resonator includes a first end and a second end, the first end is attached to the antenna feed structure, and the second end is attached to the second rectangular length of the first resonator.

2. The antenna of claim 1, wherein the second rectangular length of the first resonator includes a first side, a second side, a third side and a fourth side, and the plurality of rectangular lengths of the second portion wrap around the first side, the second side and the third side.

3. The antenna of claim 2, wherein a second separation distance is formed between the second portion of the second resonator and the second side of the second rectangular length of the first resonator.

4. The antenna of claim 3, wherein the second separation distance is between 0.5 and 2.5 mm.

5. The antenna of claim 1, wherein the first separation distance is between 0.5 and 2.5 mm.

6. The antenna of claim 3, wherein the first portion of the second resonator is attached to the antenna feed structure at an attachment end of the first portion and attached to the second portion of the second resonator at a distal end of the first portion.

7. The antenna of claim 6, wherein the plurality of rectangular lengths of the second portion of the second resonator includes a first rectangular length section, a second rectangular length section and a third rectangular length section, the first rectangular length section is attached to the distal end of the first portion and is arranged parallel to the first side of the second rectangular length of the first resonator, the second rectangular length section is attached to the first rectangular length section and is arranged parallel to the second side of the second rectangular length of the first resonator and the third rectangular length section is attached to the second section and is arranged parallel to the third side of the second rectangular length of the first resonator.

8. The antenna of claim 1, wherein the second resonator includes a third portion attached to the second portion and configured to extend a length of the second resonator.

9. The antenna of claim 1, wherein a length of the second resonator is approximately between 78 and 106 mm, and a length of the first resonator is approximately between 34 and 44 mm.

10. An electronic device having a wide band antenna and capable of wireless reception of electro-magnetic signals, the electronic device comprising:

a wireless signal module;

an antenna feed structure of the wide band antenna, the antenna feed structure is configured to provide the electro-magnetic signals to the wireless signal module;

a first resonator of the wide band antenna, the first resonator including a first rectangular length and a second rectangular length arranged perpendicular to the first rectangular length; and a second resonator of the wide band antenna, the second resonator including a first portion and a second portion, the first portion is a substantially straight linear length structure that is configured to extend parallel to the first rectangular length and the second portion includes a plurality of rectangular lengths arranged rectilinear to each other, and the plurality of rectangular lengths are configured to wrap around the second rectangular length of the first resonator, wherein a first separation distance is formed between the first rectangular length of the first resonator and the first portion of the second resonator, wherein the first rectangular length of the first resonator includes a first end and a second end, the first end is attached to the antenna feed structure, and the second end is attached to the second rectangular length of the first resonator.

11. The electronic device of claim 10, wherein the second rectangular length of the first resonator includes a first side, a second side, a third side and a fourth side, and the plurality of rectangular lengths of the second portion wrap around the first side, the second side and the third side.

12. The electronic device of claim 11, wherein a second separation distance is formed between the second portion of the second resonator and the second side of the second rectangular length of the first resonator.

13. The electronic device of claim 12, wherein the first portion of the second resonator is attached to the antenna feed structure at an attachment end of the first portion and attached to the second portion of the second resonator at a distal end of the first portion.

14. The electronic device of claim 13, wherein the plurality of rectangular lengths of the second portion of the second resonator includes a first rectangular length section, a second rectangular length section and a third rectangular length section, the first rectangular length section is attached to the distal end of the first portion and is arranged parallel to the first side of the second rectangular length of the first resonator, the second rectangular length section is attached to the first rectangular length section and is arranged parallel to the second side of the second rectangular length of the first resonator and the third rectangular length section is attached to the second section and is arranged parallel to the third side of the second rectangular length of the first resonator.

15. An antenna module for integration into an electronic device, the antenna module comprising:

an antenna carrier configured to support at least one antenna structure, wherein the at least one antenna structure includes a wide band antenna disposed on the antenna carrier, and the wide band antenna includes:

an antenna feed structure configured to sense a signal and provide the signal to a receiver;

a first resonator including a first rectangular length and a second rectangular length arranged perpendicular to the first rectangular length; and a second resonator including a first portion and a second portion, the first portion is a substantially straight linear length structure that is configured to extend parallel to the first rectangular length and the second portion includes a plurality of rectangular lengths arranged rectilinear to each other, and the plurality of rectangular lengths are configured to wrap around the second rectangular length of the first resonator, wherein a first separation distance is formed between the first rectangular length of the first resonator and the first portion of the second resonator, wherein the first rectangular length of the first resonator includes a first end and a second end, the first end is attached to the antenna feed structure, and the second end is attached to the second rectangular length of the first resonator.

16. The antenna module of claim 15, wherein the second rectangular length of the first resonator includes a first side, a second side, a third side and a fourth side, and the plurality of rectangular lengths of the second portion wrap around the first side, the second side and the third side.

17. The antenna module of claim 16, wherein a second separation distance is formed between the second portion of the second resonator and the second rectangular length of the first resonator.

18. The antenna of claim 1, wherein the plurality of rectangular lengths of the second portion of the second resonator includes a first length, a second length and a third length, and the first length is attached to the first portion of the second resonator at an end of the first portion and the first length extends perpendicular to the first portion.

* * * * *